United States Patent [19]

Janssen et al.

[11] Patent Number: 4,570,104

[45] Date of Patent: Feb. 11, 1986

[54] ELECTRIC LAMP HAVING A FUSE IN A FEED-THROUGH MOLDING

[75] Inventors: Eduard J. P. Janssen; Victor R. Notelteirs, both of Eindhoven, Netherlands

[73] Assignee: U.S. Philips Corporation, New York, N.Y.

[21] Appl. No.: 544,040

[22] Filed: Oct. 24, 1983

[30] Foreign Application Priority Data

Nov. 2, 1982 [NL] Netherlands ..... 8204236

[51] Int. Cl.[4] ..... A48B 88/00; H01J 13/46

[52] U.S. Cl. ..... 315/50; 313/318; 313/331; 315/47

[58] Field of Search ..... 315/50, 47; 313/318, 313/331

[56] References Cited

U.S. PATENT DOCUMENTS

| | | | |
|---|---|---|---|
| 1,934,435 | 11/1933 | Lessmann | 315/75 X |
| 2,248,979 | 7/1941 | Freiderich et al. | 315/47 X |
| 3,274,426 | 9/1966 | Scoledge et al. | 315/75 X |
| 3,767,965 | 10/1973 | Collins et al. | 315/75 X |
| 4,256,989 | 3/1981 | Trutner et al. | 313/318 |

*Primary Examiner*—Robert Lindsay

*Attorney, Agent, or Firm*—David R. Treacy

[57] ABSTRACT

A lamp having a ceramic molding between a cap and a lamp envelope, the current supply conductors passing through the molding between the cap and the envelope. The conductors pass through separate ducts in the molding, one of the conductors includes a fuse accommodated entirely within the duct, and that duct is sealed at an end adjacent the lamp cap by a coherent mass of material such as a base cement. Flashover from a fuse arc to either the other conductor or the lamp cap is prevented.

2 Claims, 3 Drawing Figures

ELECTRIC LAMP HAVING A FUSE IN A FEED-THROUGH MOLDING

BACKGROUND OF THE INVENTION

The invention relates to an electric lamp provided with a lamp envelope which is sealed in a vacuum-tight manner and has a wall through which pass current-supply conductors extending to a light source arranged inside the lamp envelope; and more particularly to such a lamp having a ceramic molding which is included at least inside and is fixed to part in a lamp cap the lamp envelope being fixed to the molding, and the current-supply conductors, in at least one of which a fuse wire is included, extending through the ceramic molding to contacts on the lamp cap.

Such lamps are commercially available. They are mostly constructed as halogen incandescent lamps and are used inter alia for illumination in studios and theatres.

The lamps are provided with a fuse in order to interrupt the current through the lamp when very high currents are produced. When the fuse becomes operative, a discharge arc can be obtained which can flash over to the other current conductor or, when a lamp cap with a metal sheath is used, to the sheath of the lamp cap. This may cause a fuse to open a circuit in the electrical equipment to which the lamp is connected, or the lamp cap to become fixed by welding in the lamp holder, and/or the lamp to explode.

It is known from Dutch Patent Specification No. 51431 to include in an incandescent lamp for general illumination purposes, in which the lamp cap is joined to the lamp envelope by means of cement without the interposition of a ceramic molding, a fuse in the mass of cement. For this purpose a considerable part of the lamp cap has to be filled with cement. It has been found that such a construction is unreliable because the fuse is embedded in an uncontrollable manner. The mass of cement assumes its ultimate form after the lamp envelope and the lamp cap have been joined. It has been found that gaps may be formed in the mass of cement through which a discharge arc can flash over to the sheath of the lamp cap or to the other current conductor.

It is also known (for example from British Pat. No. 830,360) to include in a lamp for general illumination purposes a fuse wire in a glass envelope sealed in a vacuum-tight manner. However, this construction requires the manufacture of an additional component, i.e. the enveloped fuse wire, and is consequently expensive.

SUMMARY OF THE INVENTION

The invention has for its object to obviate these disadvantages and to provide a lamp of a safer construction without the use of additional components.

According to the invention, this is achieved in an electric lamp of the kind described above in that the ceramic molding has a respective individual duct therethrough for each current supply conductor, any fuse wire being completely accommodated within its respective duct, and the duct being is closed by a coherent mass at its end remote from the lamp envelope.

Since the duct in which the fuse wire is accommodated is closed, a discharge arc in the lamp cap can no longer flash over to the other current conductor or to the sheath of the lamp cap. Thus, it is also prevented that, after the arc has extinguished, a voltage is applied to the sheath via an internal short circuit. If desired, as an additional safety measure, a fuse can be included in each current-supply conductor; in this case each duct in the ceramic molding is closed at the cap end.

"Fuse wire" is used herein to mean a fusable wire of any cross sectional shape, such as circular, ovoidal and rectangular.

The lamp cap is generally fixed in the ceramic molding by means of cement. The lamp cap can be secured to the ceramic molding in the same manner. In the case of a lamp cap having a metal sheath, securing may alternatively be effected by locally deforming the sheath, for example, by depressing the sheath into a recess in the moulding. Cement which is suitable for use in joining the molding to the lamp envelope and to the lamp cap may also be used for closing the duct(s) in the ceramic molding. Examples of such a cement are mixtures of talcum powder, zinc oxide and potassium silicate as well as mixtures of quartz powder, sodium silicofluoride and sodium silicate. Another possibility is the use of lead borate glass filled with sand, hard glass powder, silicon dioxide powder, aluminium oxide powder, or calcium oxide powder, for example, a mass of 3 parts by weight of glass (3% by weight of $SiO_2$, 18% by weight of $B_2O_3$, 68% by weight of PbO, 8% by weight of ZnO, 3% by weight of $Al_2O_3$) and 1 part by weight of sand.

When the ceramic molding is fixed on the end of the lamp envelope, the duct containing the fuse wire will generally be closed automatically by the end of the lamp envelope itself, but the cement joint also contributes to this closure. If desired, the duct containing the fuse wire may be filled with cement as a further safety measure in order that the fuse is completely embedded. Any discharge arc in the duct is then extinguished even more rapidly.

In a preferred embodiment, the ceramic moulding of the lamp according to the invention has a collar on which the lamp cap bears. This collar facilitates the mounting of the molding in the lamp cap.

In the lamp according to the invention, ducts in the ceramic molding can be provided, for example, with cement and closed thereby before the last assembly step in which the lamp cap is placed over the ceramic molding. Consequently, it is ensured that the coherent closing mass reaches the area at which it is needed, while the fuse(s) is (are) certain to be enclosed.

In a lamp according to the invention, a filament may be used as a light source, but it is alternatively possible that a filament and a discharge arc, for example, a high-pressure mercury vapor discharge, together act as a light source. In the latter case, the filament acts at the same time as a current-limiting member for the discharge arc.

An embodiment of the lamp according to the invention is shown in the drawing.

DESCRIPTION OF THE PREFERRED EMBODIMENT

Figure 1:
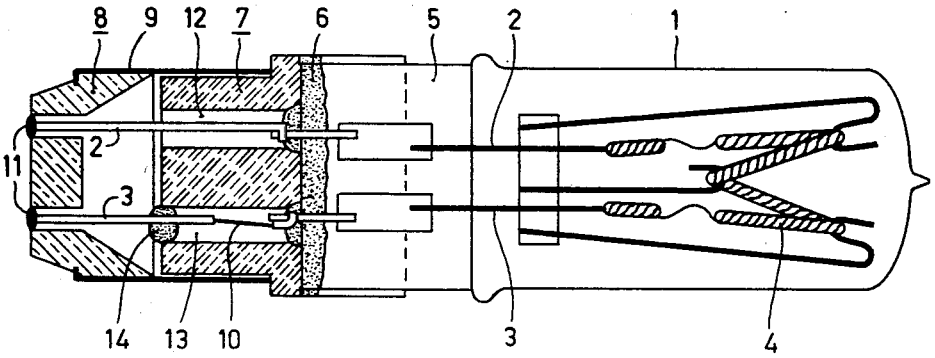
FIG. 1 is a side elevation of a lamp with the lamp cap and the ceramic molding shown in a longitudinal section.

In FIG. 1, a lamp envelope 1 is closed at one end with a pinch 5, through which current-supply conductors 2, 3 extend to a filament 4 arranged as a light source inside the lamp envelope. The lamp envelope is filled with rare gas and a hydrobromide. The end 5 of the lamp envelope 1 is fixed by means of cement 6 in a ceramic molding 7 of steatite which is partly included in a lamp cap 8 with a metal sheath 9. The current-supply conductors 2, 3 are connected to contacts 11 on the lamp cap 8. A wire 10 is included as a fuse wire in the current-supply conductor 3. The molding 7 has for each current-supply conductor 2,3 an individual duct 12, 13 which is traversed by the relevant current-supply conductor and in which the fuse wire 10 is entirely included. The end of the duct 13 remote from the lamp envelope 1, in which the fuse wire 10 is disposed, is closed by means of a coherent mass 14 of cement having the same composition as the cement 6.

Figure 2:
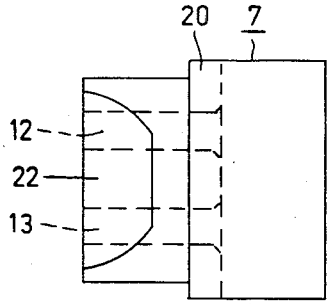
FIG. 2 is a side elevation of the ceramic moulding of FIG. 1.
Figure 3:
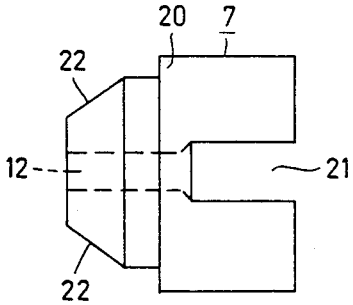
FIG. 3 is a side elevation of the molding of FIG. 2 rotated through 90°.

The lamp cap 8 abuts against a collar 20 (FIG. 2) in the ceramic molding 7. The molding has oblique edges 22 on which cement can be applied for fixing the lamp cap 8. The molding is provided with a slot 21 (FIG. 3) in which the pinch 5 at the end of the lamp envelope 1 is included. The pinch 5 closes the ducts 12, 13 in the molding 7 at each respective end facing the lamp envelope 1. In the lamp shown, before the pinch 5 was inserted completely into the slot 21, cement 6 was provided on the bottom of the slot. During the further insertion of the lamp envelope into the molding the cement became distributed so as to provide an additional closure of the ducts 12 and 13. Subsequently, the free end of the duct 13 was closed by the cement 14. It is not until then that the lamp cap 8 was provided and that the contacts 11 were connected with the current-supply conductors 2, 3. Thus, by the use of a molding 7 of special shape instead of a molding with only one cavity, a lamp is obtained without additional components, and is fuse-protected in a very reliable manner.

The lamp shown is a halogen incandescent lamp filled with a mixture of krypton and methylene bromide. During operation, at 225 V the lamp consumes a power of 150 W and is intended to be used as a projection lamp.

The lamp was operated at normal voltage and was then loaded with an overvoltage of 60%. The fuse interrupted the current through the lamp 5 msec after the application of the overvoltage. Apart from the fuse wire 10 and the filament 4, the lamp was still completely intact.

What is claimed is:

1. An internally fused electric lamp, comprising a lamp cap having at least two insulated electrical contacts, a ceramic molding disposed at least in part within said cap and fixed thereto, a sealed lamp envelope having a wall surrounding a light source, and an end secured to said molding, at least two current supply conductors extending from respective contacts on the lamp cap through said molding and said wall to said light source, and a fuse included in one of said conductors, wherein said molding has a respective individual duct therethrough for each current supply conductor, each of said ducts having an end adjacent the lamp envelope and an end remote from the lamp envelope, said fuse is completely accommodated within one of said ducts, and said one duct is closed by a coherent mass at said end remote from the lamp envelope, whereby a discharge arc caused by operation of the fuse is blocked from flashing over to the lamp cap or another current conductor.

2. The lamp as claimed in claim 1, wherein a cement of a same composition forms said coherent mass, and is used to secure the lamp envelope to said molding.

* * * * *